US008506351B2

(12) United States Patent
Shibata et al.

(10) Patent No.: US 8,506,351 B2
(45) Date of Patent: Aug. 13, 2013

(54) EYEGLASS LENS PROCESSING APPARATUS

(75) Inventors: Ryoji Shibata, Toyokawa (JP); Toshiaki Asaoka, Gamagori (JP); Yoichi Sugiura, Gamagori (JP)

(73) Assignee: Nidek Co., Ltd., Gamagori (JP)

( * ) Notice: Subject to any disclaimer, the term of this patent is extended or adjusted under 35 U.S.C. 154(b) by 503 days.

(21) Appl. No.: 12/749,824

(22) Filed: Mar. 30, 2010

(65) Prior Publication Data

US 2010/0248590 A1 Sep. 30, 2010

(30) Foreign Application Priority Data

Mar. 31, 2009 (JP) ..... 2009-087817

(51) Int. Cl.
*B24B 49/00* (2012.01)

(52) U.S. Cl.
USPC ..... 451/5; 451/8

(58) Field of Classification Search
USPC ..... 451/5, 8–11, 42–44
See application file for complete search history.

(56) References Cited

U.S. PATENT DOCUMENTS

| | | | | |
|---|---|---|---|---|
| 5,588,899 | A * | 12/1996 | Gottschald | 451/5 |
| 6,283,826 | B1 | 9/2001 | Mizuno | |
| 6,298,277 | B1 | 10/2001 | Videcoq | |
| 6,332,827 | B1 * | 12/2001 | Gottschald et al. | 451/6 |
| 6,564,111 | B1 * | 5/2003 | Gottschald | 700/95 |
| 6,785,585 | B1 | 8/2004 | Gottschald | |
| 6,790,124 | B2 | 9/2004 | Shibata | |
| 6,813,536 | B1 * | 11/2004 | Gottschald | 700/160 |
| 7,500,315 | B2 | 3/2009 | Takeichi | |
| 7,611,243 | B2 * | 11/2009 | Takeichi | 351/178 |
| 7,925,371 | B2 * | 4/2011 | Takeichi | 700/160 |
| 2002/0155787 | A1 | 10/2002 | Luderich | |
| 2009/0011687 | A1 | 1/2009 | Shibata et al. | |

FOREIGN PATENT DOCUMENTS

| | | | |
|---|---|---|---|
| JP | 11-333684 | A | 12/1999 |
| JP | 2003-145328 | A | 5/2003 |
| JP | 2007-229861 | A | 9/2007 |

OTHER PUBLICATIONS

Extended European Search Report, Application No. 10003478.4, dated Aug. 13, 2010.

* cited by examiner

*Primary Examiner* — Dung Van Nguyen
(74) *Attorney, Agent, or Firm* — Sughrue Mion, PLLC

(57) ABSTRACT

An eyeglass lens processing apparatus includes: a processing chamber; a pair of lens chuck shafts which chucks an eyeglass lens; a lens rotating unit including a motor for rotating the lens chuck shafts; a processing tool which processes a periphery of the lens; an axis-to-axis distance changing unit for changing an axis-to-axis distance between a rotating shaft attached to the processing tool and the lens chuck shafts; a data input unit for inputting processing condition data including a target lens shape; a processing controller which controls the lens rotating unit and the axis-to-axis changing unit to process the lens based on the input processing condition data a camera which is disposed in the processing chamber and takes a video picture of the processing of the lens; and a memory which stores video pictures and the processing condition data.

6 Claims, 10 Drawing Sheets

EYEGLASS LENS PROCESSING APPARATUS

BACKGROUND

The present invention relates to an eyeglass lens processing apparatus for processing the periphery of an eyeglass lens.

In processing the periphery of an eyeglass lens, data necessary for the lens processing such as the target lens shape data and the layout data of the optical center of the lens with respect to the target lens shape is inputted, and the eyeglass lens held by lens chuck shafts is processed by a periphery processing tool such as a grindstone and a grooving tool based on the input data. Moreover, the attachment holes of a rimless frame are drilled in the lens refractive surface by a drilling tool (Japanese Unexamined Patent Application Publication No. H11-383684 [U.S. Pat. No. 6,283,826], Japanese Unexamined Patent Application Publication No. 2003-145328 [U.S. Pat. No. 6,790,124]).

An eyeglass lens processing apparatus is constituted by an extremely precise and complicated mechanism, and lenses are processed by a complicated control program. Moreover, the eyeglass processing apparatus requires the input of various processing conditions, and the operator is required to perform the operation according to the procedures without confusing the right and left lenses. However, when the apparatus operates abnormally, when some mechanical failure occurs or when the control program is defective, a trouble occurs in that the lens is not processed as laid out or that the apparatus is stopped in the middle. Moreover, when the operator erroneously inputs a processing condition, when the operator confuses the right and left lenses or when the operator does not perform the operation according to the procedures, a trouble also occurs in that the lens is not processed as laid out.

When such a trouble occurs and the operator cannot solve the trouble by himself or herself, the operator explains the condition of the trouble to the salesperson or the serviceperson, presents the lens not processed as laid out, and requests the maker of the apparatus to solve the trouble. However, the operator's explanation of the trouble condition varies among individuals, and it frequency occurs that the maker of the apparatus cannot obtain necessary information accurately. Moreover, there are cases where the operator cannot grasp the trouble condition itself. It may be possible to find the cause of the trouble and solve it if the trouble is reproduced at the spot where the serviceperson visits. However, there are cases where the trouble is not reproduced, and it takes time to handle the trouble. There are also cases where the serviceperson cannot find the cause of the trouble or solve the trouble and only an expert engineer of the maker of the apparatus can handle the trouble. Moreover, it is desired to prevent a simple misoperation by the operator and the like.

SUMMARY

In view of the above-mentioned problem of the related art, an object of the present invention is to provide an eyeglass lens processing apparatus capable of facilitating and speeding trouble handling at the time of the lens processing.

To solve the above-mentioned problem, the exemplary embodiments of the present invention provide the following arrangements:

(1) An eyeglass lens processing apparatus comprising:

a processing chamber;

a pair of lens chuck shafts which is disposed in the processing chamber and chucks an eyeglass lens;

a lens rotating unit including a motor for rotating the pair of lens chuck shafts;

a processing tool which is disposed in the processing chamber and processes a periphery of the lens;

an axis-to-axis distance changing unit including a motor for changing an axis-to-axis distance between a rotating shaft attached to the processing tool and the lens chuck shafts;

a data input unit for inputting processing condition data including a target lens shape;

a processing controller which controls the lens rotating unit and the axis-to-axis changing unit to process the periphery of the lens based on the input processing condition data;

a camera which is disposed in the processing chamber and takes a video picture of the processing of the lens; and a memory which stores video pictures taken by the camera and processing condition data input by the input unit.

(2) The eyeglass lens processing apparatus according to (1) further comprising:

a display;

a video picture specifying unit which has a screen for specifying one of the video pictures stored in the memory; and a display controller which controls the display to play back the specified video picture by reading out the specified video picture from the memory, and controls the display to display one of the processing condition data of the lens of the specified video picture by reading out one of the processing condition data of the lens of the specified video picture from the memory.

(3) The eyeglass lens processing apparatus according to (1) further comprising:

a connection unit which is connectable to an external storage device;

a video picture specifying unit which has a screen for specifying one of the video pictures stored in the memory; and a data transmission controller which transmits the specified video picture from the connection unit to the external storage device by reading out the specified video picture from the memory, and transmits one of the process condition data of the lens of the specified video picture as additional data from the connection unit to the external storage device by reading out one of the process condition data of the specified video picture from the memory.

(4) The eyeglass lens processing apparatus according to (3), wherein the memory stores processing control data, the data transmission controller transmits one of the processing control data of the lens of the specified video picture as the additional data from the communication unit to the external storage device by reading out one of the processing control data of the lens of the specified video picture from the memory.

(5) The eyeglass lens processing apparatus according to (3) further comprising a detector which includes a tracing stylus contacting with a refractive surface of the lens and a sensor for detecting a movement of the tracing stylus, and detects an edge position of the lens based on the target lens shape, wherein the memory stores detecting results of the edge position by the detector, and wherein the data transmission controller transmits one of the detecting results of the edge position of the lens of the specified video picture as the additional data from the communication unit to the external storage device by reading out one of the detecting results of the edge position of the lens of the specified video picture from the memory.

(6) The eyeglass lens processing apparatus according to (1) further comprising:

a switch for inputting a processing start signal for starting the processing of the lens; and a storage controller which stores the video picture taken by the camera and the processing condition data in the memory, wherein the storage controller stores the video picture and the processing condition data in the memory, in such a manner that the video picture and the processing condition data can be specified, based on the processing start signal and an end signal indicative of an end of the processing from the processing controller.

DETAILED DESCRIPTION OF EXEMPLARY EMBODIMENTS

Figure 1:
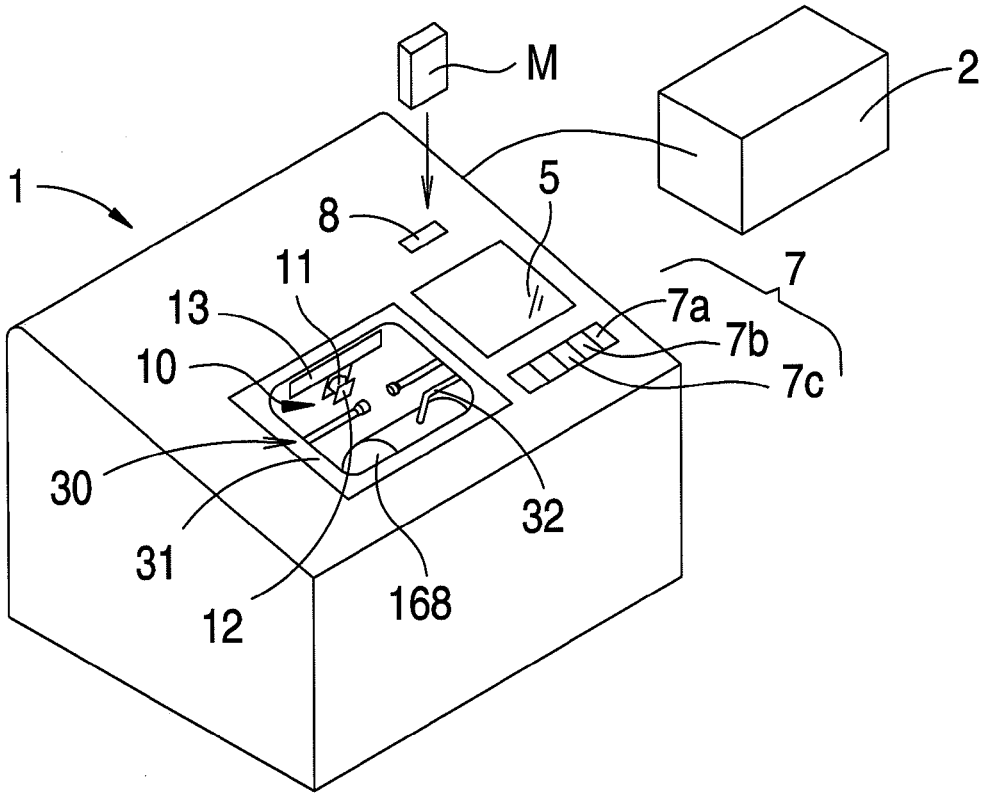
FIG. 1 is an external structure view of an eyeglass lens processing apparatus.

FIG. 1 is a view showing the external structure of an eyeglass lens processing apparatus according to the present invention. An eyeglass frame shape measurement apparatus 2 is connected to an eyeglass lens apparatus body 1, and the target lens shape data of the lens frames of the eyeglass frame obtained by the eyeglass frame shape measurement apparatus 2 is inputted to the apparatus body 1. As the eyeglass frame shape measurement apparatus 2, one can be used that is described in Japanese Unexamined Patent Application Publication No. H05-212661 (U.S. Pat. No. 5,347,762). A structure may be employed in which the target lens shape data is inputted through a communication line such as an online network or the like.

A processing chamber 30 for performing lens processing is disposed in the apparatus body 1, and an openable window 31 is attached to an upper part of the processing chamber 30. The grinding water used in lens processing can be prevented from leaking to the outside by closing the openable window 31 in the lens processing. A touch panel display 5 and a switch unit 7 including various kinds of switches for processing specification are disposed on an upper part of the apparatus body 1. The data of the processing conditions necessary for the processing such as the layout data, the hole position data and the processing mode is inputted on a screen displayed on the display 5. The display 5 serves also as a display unit for video picture display. Various switches such as a switch 7*a* for the input of a lens chuck shaft opening and closing specification signal, a switch 7*b* for the input of a lens processing start signal and a switch 7*c* for the selection between the right or left lens are disposed in the switch unit 7. The apparatus body 1 is provided with a portable external memory M for taking out data such as video picture data and processing conditions to the outside or a connection unit 8 to which a communication line of the Internet or the like is connected.

Figure 2:
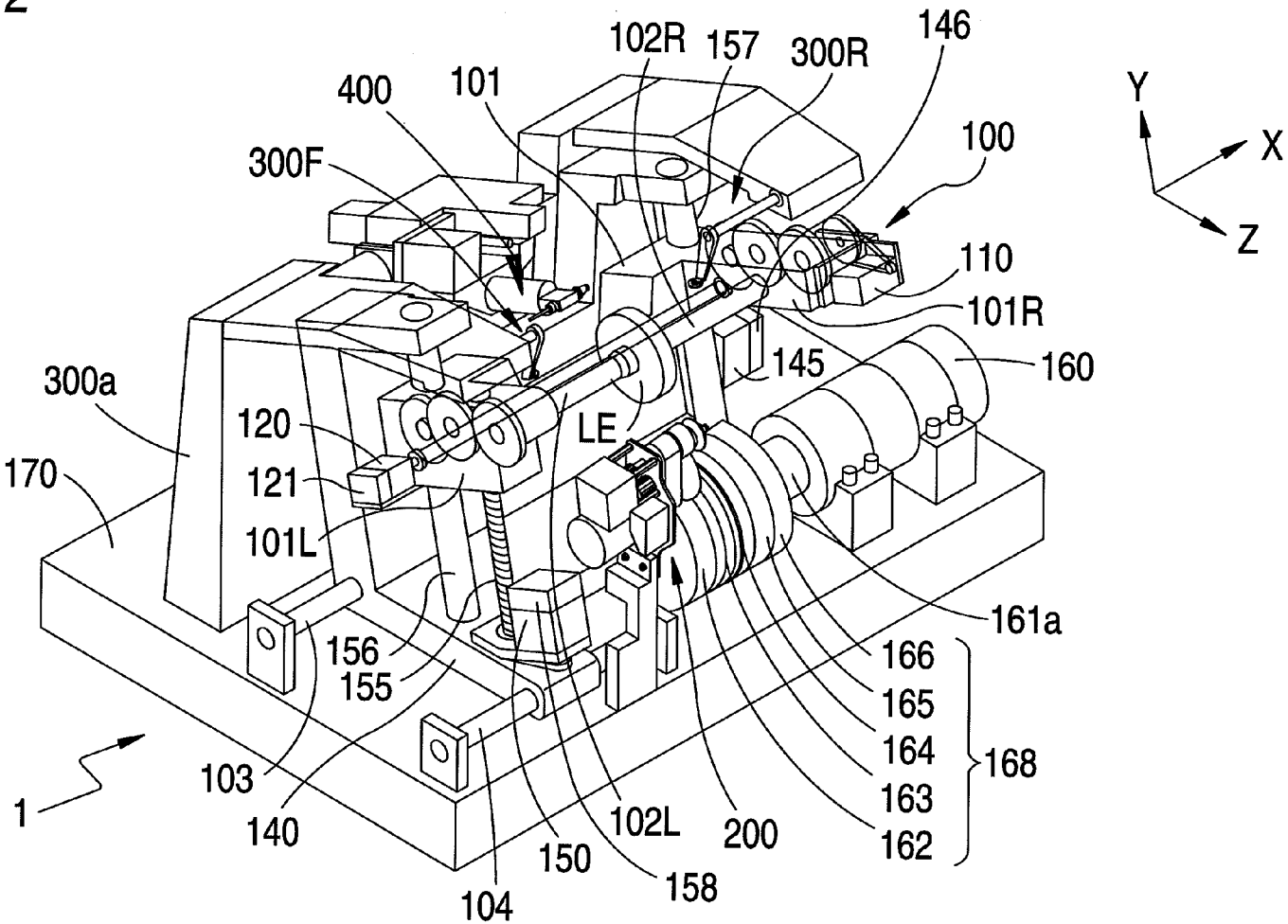
FIG. 2 is a schematic structural view of a processing unit of a processing apparatus.

FIG. 2 is a schematic structural view of a processing unit of a processing apparatus 1. A carriage unit 100 is mounted on a base 170 of an apparatus body 1. The periphery of an eyeglass lens LE sandwiched between lens chuck shafts 102L and 102R of a carriage 101 is processed while being pressed against a grindstone group 168 as a processing tool attached coaxially with a grindstone spindle (grindstone rotation axis) 161*a*. The grindstone group 168 includes: a rough grindstone 162 for glass; a high-curve bevel finishing grindstone 163 having a bevel forming a bevel on a high-curve lens; a finishing grindstone 164 having a V-groove (bevel groove) VG forming a bevel on a low-curve lens and a fiat processing surface; a polishing grindstone 165; and a rough grindstone 166 for plastic. The grindstone spindle 161*a* is rotated by a motor 160.

The lens chuck shaft 102L and the lens chuck shaft 102R are coaxially held by a left arm 101L and a right arm 101R of the carriage 101 so as to be rotatable, respectively. The lens chuck shaft 102R is moved toward the lens chuck shaft 102L side by a motor 110 attached to the right arm 101R, and the lens LE is held by the two lens chuck shafts 102R and 102L. The two lens chuck shafts 102R and 102L are rotated in synchronism with each other through a rotation transmission mechanism such as a gear by a motor 120 attached to the left arm 101L. These members constitute lens rotation unit. Rotation information of the lens LE rotated by the motor 120 is detected by an encoder 121 attached to the motor 120.

The carriage 101 is mounted on an X-axis movement support base 140 movable along shafts 103 and 104 extending parallel to the lens chuck shafts 102R and 102L and the grindstone spindle 161*a*. A non-illustrated ball screw extending parallel to the shaft 103 is attached to a rear part of the support base 140. The ball screw is attached to the rotation axis of a motor 145 for X-axis movement. By the rotation of the motor 145, the carriage 101 together with the support base 140 is linearly moved in an X-axis direction (the axial direction of the lens chuck shafts). These members constitute X-axis direction movement unit. The rotation axis of the motor 145 is provided with an encoder 146 as a detector that detects the movement of the carriage 101 in the X-axis direction.

Shafts 156 and 157 extending in a Y-axis direction (the direction in which the axis-to-axis distance between the lens chuck shafts 102R and 102L and the grindstone spindle 161*a* is varied) are fixed to the support base 140. The carriage 101 is mounted on the support base 140 so as to be movable in the Y-axis direction along the shafts 156 and 157. A motor 150 for Y-axis movement is fixed to the support base 140. The rotation of the motor 150 is transmitted to a ball screw 155 extending in the Y-axis direction, and the carriage 101 is moved in the Y-axis direction by the rotation of the ball screw 155. These members constitute Y-axis direction movement unit. The rotation axis of the motor 150 is provided with an encoder 158 as a detector that detects the movement of the carriage 101 in the Y-axis direction. Incidentally, X-axis movement unit and the Y-axis movement unit may be designed so that the grindstone group 168 (grindstone spindle 161*a*) is relatively moved with respect to the lens LE (lens chuck shafts 101R, 102).

Figure 3:
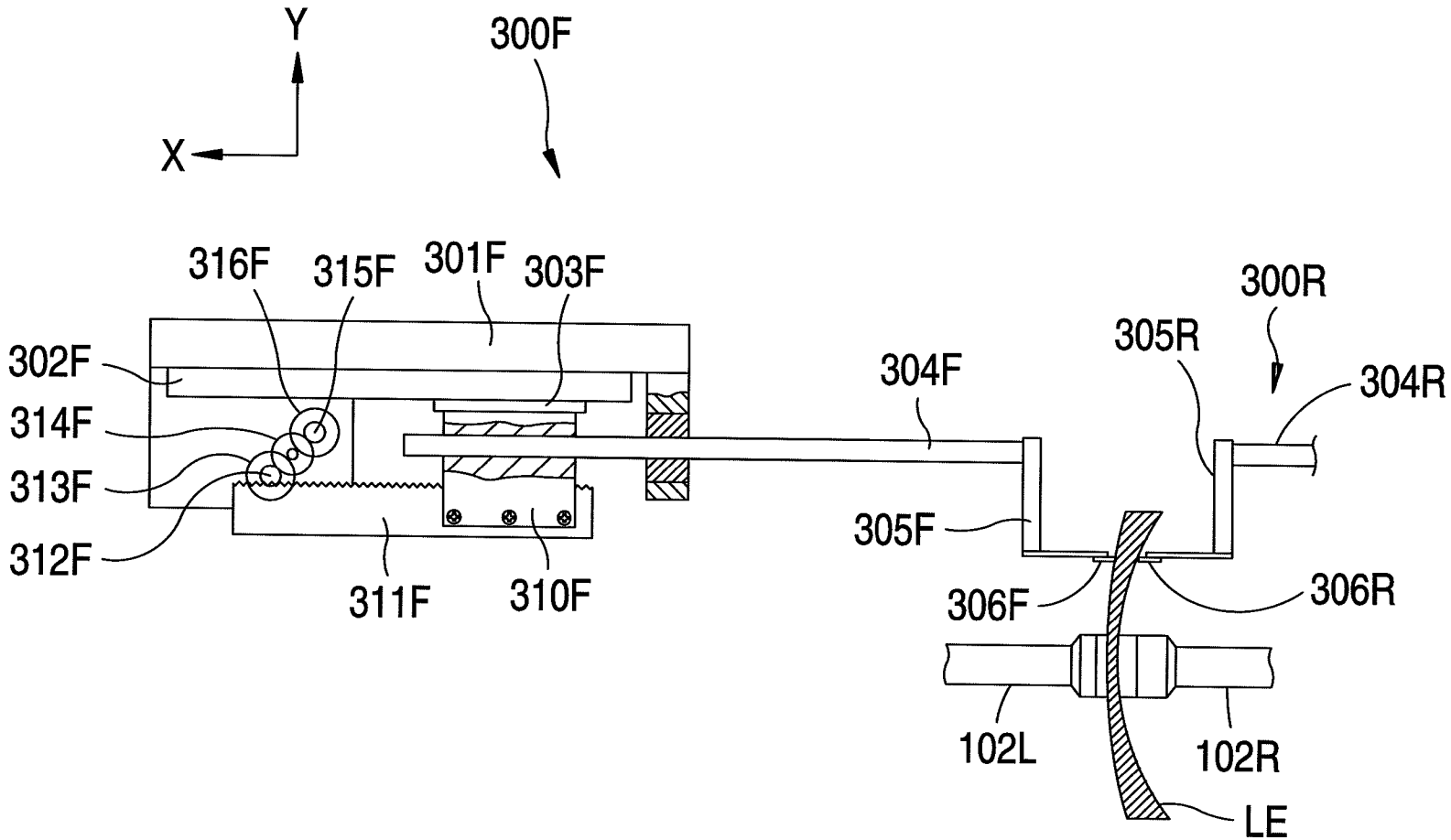
FIG. 3 is a schematic structural view of a target lens shape measurement unit.

In FIG. 2, target lens shape measurement units (lens edge position detection units) 300F and 300R are provided above the carriage 101. FIG. 3 is a schematic structural view of the measurement unit 300F that measures the lens edge position of the lens front surface. An attachment support base 301F is fixed to a support base block 300*a* secured onto the base 170 of FIG. 2, and a slider 303F is attached so as to be slidable on a rail 302F fixed to the attachment support base 301F. A slide base 310F is fixed to the slider 303F, and a tracing stylus arm 304F is fixed to the slide base 310F. An L-shaped hand 305F is fixed to an end of the tracing stylus arm 304F, and a tracing stylus 306F is fixed to an end of the hand 305F. The tracing stylus 306F is in contact with the front refractive surface of the lens LE.

A rack 311F is fixed to a lower end portion of the slide base 310F. The rack 311F meshes with a pinion 312F of an encoder 313F fixed to the attachment support base 301F side. The rotation of a motor 316F is transmitted to the rack 311F through a gear 315F, an idle gear 314F and the pinion 312F, so that the slide base 310F is moved in the X-axis direction. During the lens edge position measurement, the motor 316F pushes the tracing stylus 306F against the lens LE with a constant force at all times. The force with which the tracing stylus 306F is pushed against the lens refractive surface by the motor 316F is light so that the lens refractive surface is not flawed. An element for applying the force with which the tracing stylus 306F is pushed against the lens refractive surface may be a known pressure applying means such as a spring. The encoder 313F detects the movement position of the tracing stylus 306F in the X-axis direction by detecting the movement position of the slide base 310F. The edge position of the front surface of the lens LE (including the lens front surface position) is measured based on the information on the movement position, information on the rotation angles of the lens chuck shafts 102L and 102R and information on the movement in the Y-axis direction.

Since the structure of the measurement unit 300R that measures the edge position of the rear surface of the lens LE is symmetrical to that of the measurement unit 300F, the letter "F" following the reference numerals assigned to the structural elements of the measurement unit 300F illustrated in FIG. 3 is changed to "R", and a description thereof is omitted.

In the lens edge position measurement, the tracing stylus 306F is made to abut on the lens front surface, and a tracing stylus 306R is made to abut on the lens rear surface. Under this condition, the carriage 101 is moved in the Y-axis direction based on the target lens shape data and the lens LE is rotated, whereby the edge positions of the lens front surface and the lens rear surface for lens periphery processing are simultaneously measured. In an edge position measurement unit in which the tracing stylus 306F and the tracing stylus 306R are integrally movable in the X-axis direction, the lens front surface and the lens rear surface are separately measured. While the lens chuck shafts 102L and 102R are moved in the Y-axis direction in the target lens shape measurement units 300F and 300R, a mechanism may be adopted in which the tracing stylus 306F and the tracing stylus 306R are relatively moved in the Y-axis direction.

Figure 4:
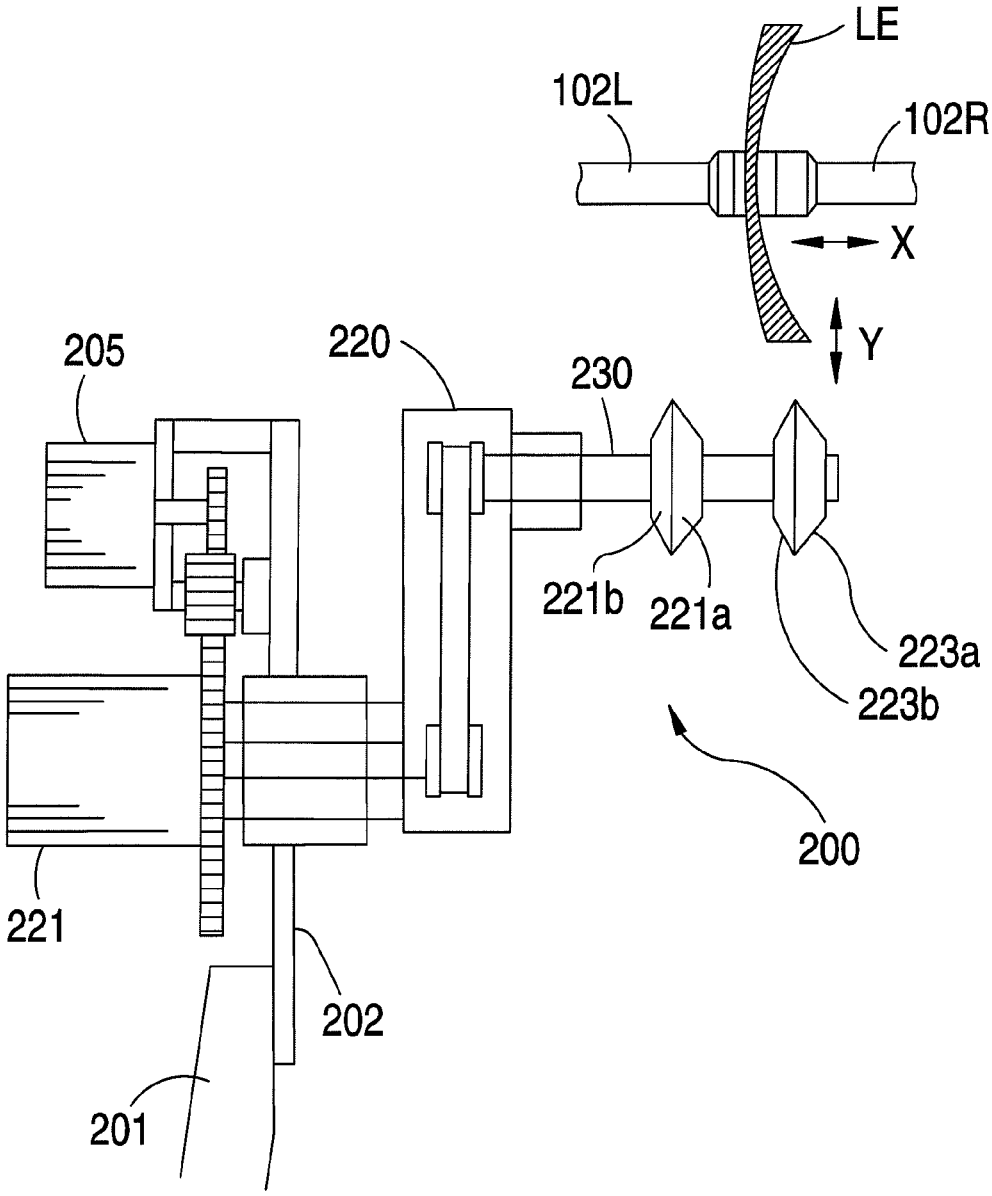
FIG. 4 is a structural view of a chamfering mechanism.
Figure 5:
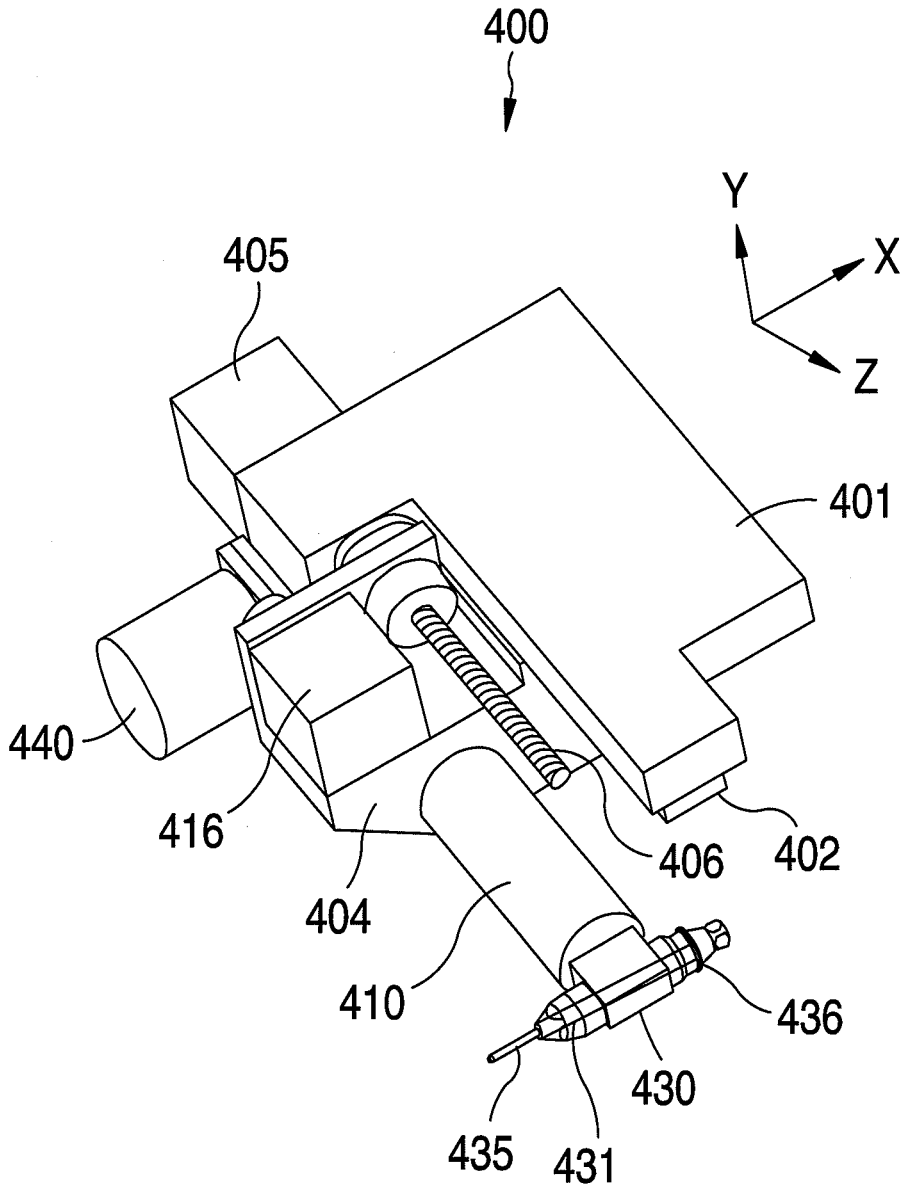
FIG. 5 is a schematic structural view of a drilling and grooving mechanism.

In FIG. 2, a chamfering mechanism 200 is disposed on the front side of the apparatus body. FIG. 4 is a structural view of the chamfering mechanism 200. A lens front surface beveling grindstone 221*a*, a lens rear surface chamfering grindstone 221*b*, a lens front surface chamfer-polishing grindstone 223*a* and a lens rear surface chamfer-polishing grindstone 223*b* are coaxially attached to a grindstone rotation shaft 230 rotatably attached to an arm 220. The grindstone rotation shaft 230 is rotated by a motor 221 through a rotation transmission mechanism such as a belt in the arm 220. The motor 221 is fixed to a fixed plate 202 extending from a support base block 201. A motor 205 for rotating the arm is fixed to the fixed plate 202, and the rotation of the motor 205 moves the grindstone rotation shaft 230 from a retracted position into a processing area shown in FIG. 4. The processing area of the grindstone rotation shaft 230 is a position parallel to the lens rotation shafts 102R and 102L on a plane where the rotation shafts are situated, between the rotation shafts 102R and 102L and the grindstone rotation shaft 161*a*. Similarly to the lens periphery processing by a grindstone 168, the lens LE is moved in the Y-axis direction by the motor 150, and the lens LE is moved in the X-axis direction by the motor 145, whereby the lens periphery is chamfered.

In FIG. 2, a drilling and grooving mechanism 400 is disposed behind the carriage unit 100. FIG. 4 is a schematic structural view of the mechanism 400. A fixed plate 401 serving as the base of the mechanism 400 is fixed to a block (not shown) disposed on the base 170 of FIG. 2 in a standing condition. A rail 402 extending in a z-axis direction (the direction orthogonal to the X-Y plane) is fixed to the fixed plate 401, and a z-axis movement support base 404 is attached so as to be slidable along the rail 402. The movement support base 404 is moved in the z-axis direction by a motor 405 rotating a ball screw 406. A rotation support base 410 is rotatably held by the movement support base 404. The rotation support base 410 is axially rotated by a motor 416 through a rotation transmission mechanism.

A rotary portion 430 is attached to an end of the rotation support base 410. A rotation shaft 431 orthogonal to the axial direction of the rotation support base 410 is rotatably held by the rotary portion 430. An end mill 435 as a drilling tool is coaxially attached to one end of the rotation shaft 431, and a grooving cutter 436 as a grooving tool is coaxially attached to the other end of the rotation shaft 431. The rotation shaft 431 is rotated by a motor 440 attached to the movement support base 404, through a rotation transmission mechanism disposed in the rotary portion 430 and the rotation support base 410. In the present embodiment, the end mill 435 faces the lens front surface, and drilling is performed from the lens front surface side.

As the structures of the carriage unit 100, the measurement units 300F and 300R and the drilling and grooving mechanism 400, basically, those described in Japanese Unexamined Patent Application Publication No. 2003-145328 (U.S. Pat. No. 6,790,124) may be used, and thus a detailed explanation thereof is omitted.

Figure 6:
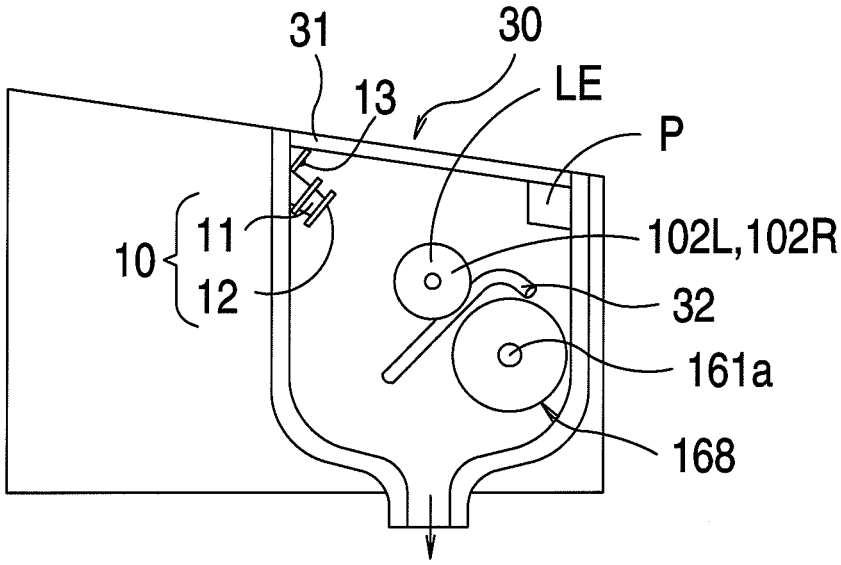
FIG. 6 is a schematic side view of the inside of a processing chamber.

FIG. 6 is a schematic view of the inside of the processing chamber 30 of the apparatus body 1 viewed from a side. A grindstone group 168 attached to the grindstone spindle (grindstone rotation shaft) 161*a* and the lens chuck shafts 102L and 102R are disposed in the processing chamber 30. A nozzle 32 is also disposed for removing processing cuttings caused in the lens processing and jetting grinding water for cooling the frictional heat caused between the lens LE and the grindstone group 168. The nozzle 32 is supplied with grinding water from a grinding water supply unit (not shown).

In FIGS. 1 and 6, a video picture taking unit 10 for taking a video picture of the processing condition and the like of the lens LE and an illuminating light source 13 for illuminating the inside of the processing chamber 30 are disposed in the processing chamber 30. The video picture taking unit 10 includes a camera 11 capable of taking video pictures and a waterproofing mechanism 12 for electrically protecting the camera 11 from the processing cuttings and the grinding water. The camera 11 has an angle of view where it can take a video picture of a series of the operations of the lens processing (chucking, target lens shape measurement, lens periphery processing, drilling, etc.), and is disposed in a position where it can take a video picture of the positional relationship between the lens LE and the grindstone group 168. That is, the camera 11 is disposed in a position where the camera 11 can take a video picture of a range in which the lens chuck shafts 102L and 102R and the lens LE are relatively movable in the X-axis direction with respect to the grindstone group 168 and a range in which they are movable in the Y-axis direction. In the present embodiment, the right-left direction of the camera 11 is set to a substantially central position in the right-left direction of the processing chamber 30. The up-down direction of the camera 11 is disposed in an upper part of the processing chamber 30 in a position shifted from a direction connecting the rotation center of the grindstone 168 and the rotation center of the lens chuck shafts 102L and 102R in order that the movement, in the Y-axis direction, of the lens chuck shafts 102L and 102R with respect to the grindstone 168 is visually apparent.

When there is space in the processing chamber 30, it is desirable that the camera 11 of the video picture taking wait 10 be disposed in a position P in an upper part of the processing chamber 80. The position P is substantially the center position of the rotation center of the lens chuck shafts 102L and 102R and the rotation center of the grindstone 168 in a direction vertical to the direction connecting the rotation center of the lens chuck shafts 102L and 102R and the rotation center of the grindstone 168 (see FIG. 6). When the video picture taking unit 10 is disposed in the position P, video picture is taken from a direction the same as the direction in which the operator actually checks the processing condition in the processing chamber 30, and this facilitates the operator's understanding when the operator checks the video picture data.

The waterproofing mechanism 12 is attached to the front surface of the camera 11, and electrically protects the camera 11 from water drops discharged from the nozzle 32. For the waterproofing mechanism 12, a transparent hydrophilic sheet or the like is used where surface tension does not easily work and the water adhering to the surface does not readily become water drops. The illuminating light source 13 is disposed in a position that does not obstruct the video picture taken by the camera 11 (position where no backlight condition is caused). It is desirable that the illuminating light source 13 be disposed in a position where the luminous flux is not interrupted by the illuminating light source 13.

While video picture of the inside of the processing chamber 30 is taken by using one camera 11 in the present embodiment, a structure may be adopted in which a plurality of cameras 11 are set in the processing chamber 30 so that video picture of the processing condition is taken from different angles. For example, the camera 11 is placed in a position where video picture of the lens processing condition and the like are taken from a side surface side (X-axis direction) of the processing chamber 30. Alternatively, the camera 11 may be switched every processing step so that video picture data from a direction where the processing condition is more easily checked is obtained.

Figure 7:
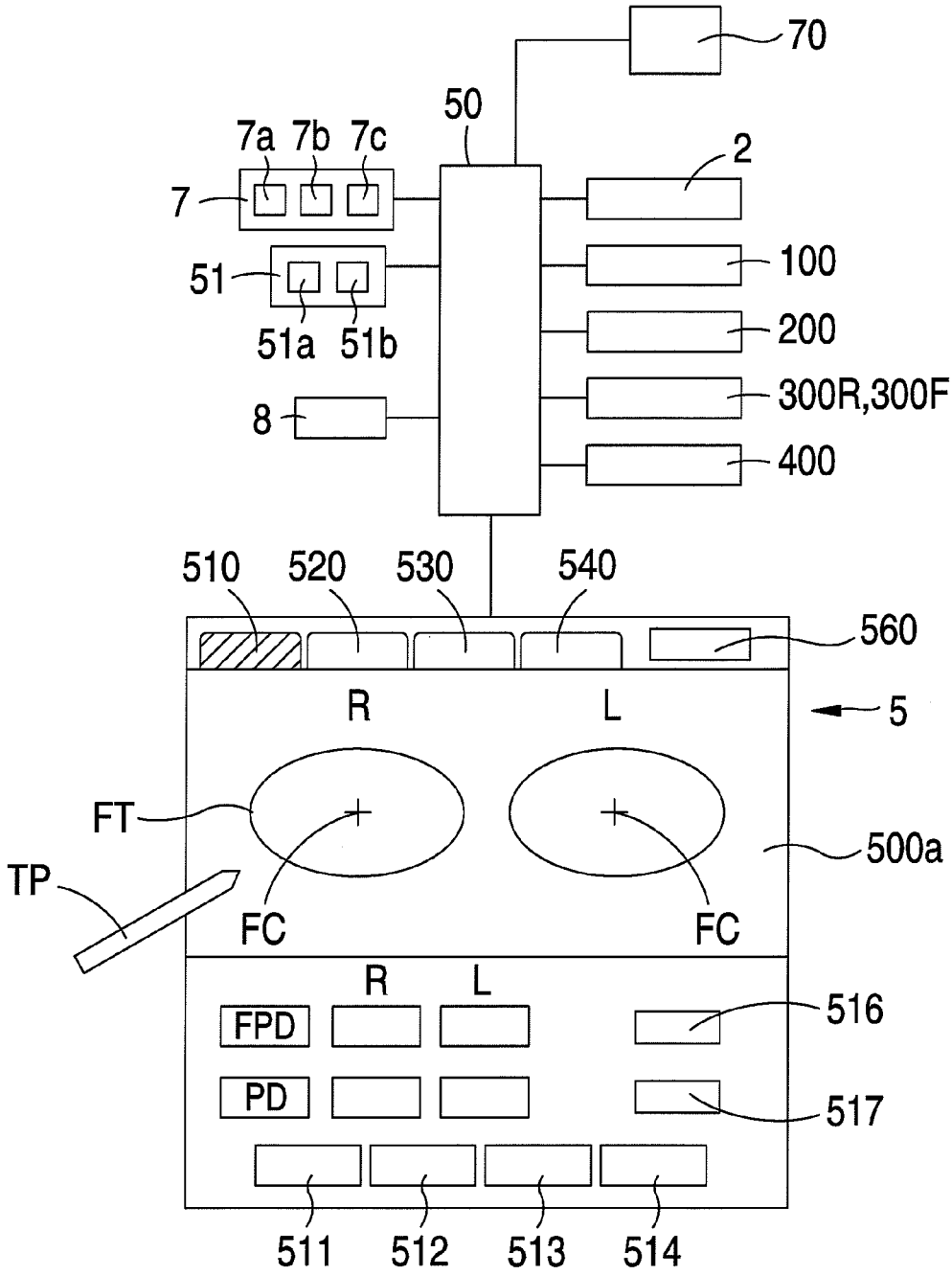
FIG. 7 is a control block diagram of the eyeglass lens processing apparatus.

FIG. 7 is a control block diagram of the eyeglass lens processing apparatus. The following are connected to a control unit 50: an eyeglass frame shape measurement unit 2; a memory 51 for storing video picture data taken by the camera 11; a connection unit 8 such as an external storage memory M; the display 5 having a touch panel function; the switch unit 7; the carriage unit 100; the chamfering mechanism 200; measurement units 300F and 300R; and the drilling and grooving mechanism 400. On the display 5, a predetermined signal can be inputted to the display on the screen by a touch operation with a finger or a touch pen TP. The control unit 50 receives the input signal by the touch panel function of the display 5, and controls the display of diagrams and information on the display 5.

The memory 51 includes a temporary storage memory 51*a* for temporarily storing the video picture data taken by the camera 11 and a recording memory 51*b* for permanently storing the video picture data selected from the video picture data recorded in the temporary storage memory 51*a*. In the temporary storage memory 51*a*, to save the memory space, for example, the five latest pieces of video picture data are stored in the order in which they are obtained, and when the number of pieces exceeds five, the oldest piece is successively deleted. On the other hand, in the recording memory 51*b*, of the video picture data registered in the temporary storage memory 51*a*, the video picture data selected by the operator is copied and stored.

On the screen of the display 5, a plurality of tabs 510, 520, 530 and 540 are prepared for inputting a screen switch signal. The tabs 510 to 540 are associated with edit screens for setting various processing conditions. When the tab 510, 520, 530 or 540 are selected by a touch operation, the screen displayed on the display 5 is switched.

The tab 510 corresponds to a layout screen 500*a*. FIG. 7 illustrates an example of the layout screen 500*a*. On the layout screen 500*a*, the target lens shapes of both eyes are displayed in full size, and buttons 511 to 514 for setting various processing conditions (the lens material, the frame type, the presence or absence of beveling, the processing mode) are displayed. Moreover, a tracer button 516 for reading the target lens shape data measured by the eyeglass frame shape measurement apparatus 2 is provided.

The tab 520 corresponds to a hole edit screen. On the non-illustrated hole edit screen, various input buttons for inputting data on the hole diameter, the hole angle and the hole depth and input buttons for making various drilling settings such as an operation button for setting the hole position on the layout are displayed. The tab 530 corresponds to a partial grooving edit screen for specifying the depth and width of a groove and performing partial grooving. On a non-illustrated partial grooving edit screen, various input buttons for performing partial grooving such as a button for inputting data on the width and depth of a groove partially set on the target lens shape are displayed. Automatic grooving to form a groove on the entire periphery of the lens is set by selecting a frame type "nylol" and a processing mode "auto" with a button 512 and a button 513 of the layout screen 500*a*, respectively. In addition, various processing condition edit screens such as a tab 540 for displaying a chamfering edit screen is prepared.

Figure 8:
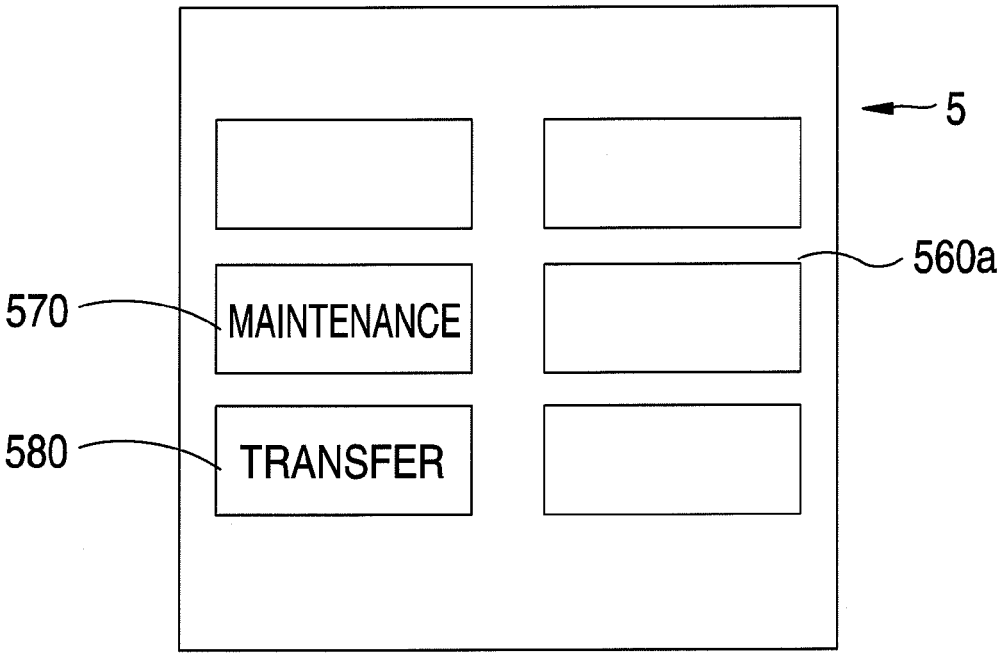
FIG. 8 shows an example of a menu screen.

When a menu button 560 on the right of the tag 540 is selected, a menu screen 560*a* is displayed. FIG. 8 shows an example of a menu screen 560*a*. The menu screen 560*a* is provided with: a button for displaying a display screen of the number of lenses to be processed; a button for displaying a bevel position and axis angle adjustment screen; a button 570 for displaying a maintenance screen having the function of displaying video picture data in the temporary storage memory 51*a* and storing the video picture data into the recording memory 51*b*; and a button 580 for displaying a screen for transferring the video picture data stored in the recording memory 51*b*, to the outside. Detailed descriptions of a maintenance screen 570*a* (see FIGS. 9A and 9B) and a transfer screen 580*a* (see FIG. 10) will be given later.

Next, the operation of the apparatus having the above-described structure will be described. The target lens shape data obtained based on the rim (lens frame) shape measured by the eyeglass frame shape measurement apparatus 2 is inputted by pressing the button 516, and stored in the memory 51. The target lens shape data is provided in the form of a radius vector length and a radius vector angle as (rn, θn)(n=1, 2, . . . , N).

When the target lens shape data is inputted, a target lens shape diagram FT based on the target lens shape data is displayed on the screen 500*a* of the display 5. On the screen 500*a*, the following data can be inputted: the distance between the pupils of the user (PD value); the distance between the frame centers of the right and left rims RM (FPD value); and layout data such as the height of the optical center of the lens LE with respect to the geometric center of the target lens shape (data on the positional relationship of the optical center of the lens LE to the geometric center of the target lens shape). The layout data can be inputted by operating a predetermined button on the screen 500*a*. Processing conditions such as the lens material, the type of eyeglass frame (a nylol type, a full metal type, a cell type, a rimless type, etc.), the processing mode (whether the type of lens periphery processing is beveling or flat processing, etc.), the presence or absence of grooving, the presence or absence of drilling, the chuck center of the lens (an optical center chuck, a frame center chuck) are set by the buttons 511 to 514. The chuck center of the lens is set to a "frame center mode" or an "optical center mode" by the button 517.

Next, prior to the processing of the lens LE, the operator fixes a cup as a fixing jig to the front surface of the lens LE by using a known blocker. In the frame center mode, the geometric center FC of the target lens shape is held by the lens chuck shafts 102R and 102L, and becomes the rotation center of the lens LE (the processing center of the lens LE). On the other hand, in the optical center mode, the optical center of the lens is held by the lens chuck shafts 102L and 102R. The processing condition data includes data on a distinction whether the lens LE to be processed is for the right eye or the left eye, and whether the lens LE is for the right eye or the left eye is selected by the switch 7*c*.

When the input of the processing conditions necessary for the processing is completed, the operator attaches the base of the cup fixed to the lens LE, to a cup holder attached to an end of the lens chuck shaft 102L, and presses the switch 7*a*. When the signal of the switch 7*a* is inputted, the motor 110 is driven by the control unit 50, and the lens LE is chucked between the lens chuck shafts 102L and 102R. Then, when the processing start signal of the switch 7*b* is inputted, the control unit 50 executes a control program of the processing based on the inputted processing conditions, and starts the video picture taking by the camera 11. By the control program of the processing, the control unit 50 first actuates the measurement units 300F and 300R, and measures the edge positions of the lens front surface and the lens rear surface based on the target lens shape data. For example, when beveling is specified, measurement is performed at the bevel apex position and at a position a predetermined distance (0.5 mm) outside from the bevel apex position. After the information on the edge positions of the lens front and rear surfaces is obtained, the control unit 50 calculates the bevel path. As the bevel path, for example, the bevel apex is set on the entire periphery so that the edge thickness is divided at a predetermined ratio (for example, 3 to 7 from the lens front surface side).

After the measurement of the lens edge position is finished, the process shifts to the lens periphery processing. The movements of the lens chuck shafts 102R and 102L in the X-axis direction and the Y-axis direction are controlled based on the target lens shape data, and roughing is performed on the periphery of the lens LE by a rough grindstone 166. Then, the periphery of the lens LE is finished by the finishing grindstone 164. When the beveling mode is set, the X-axis movement and the Y-axis movement of the lens chuck shafts 102R and 102L are controlled based on the bevel path data, and a bevel is formed on the periphery of the lens LE by the finishing grindstone 164.

When the flat processing mode or the drilling mode is set, after the roughing is finished, the lens periphery having undergone the roughing is flat-finished by the flat part of the finishing grindstone 164. When the drilling mode is set, the process shifts to the drilling by the drilling and grooving mechanism 400. When drilling is performed in a direction parallel to the lens chuck shafts (102L, 102R), the control unit 50 situates the axis (rotation shaft 431) of a drill 435 so as to be parallel (x direction) to the lens chuck shafts by the driving of the motor 416. Moreover, by the up-down (y direction) movement of the carriage 101 by the motor 150, the front-back (z direction) movement of the drill 485 by a motor 405 and the rotation of the lens chuck shafts (102L, 102R) by a motor 120, the end of the drill 435 is situated in the drilling position of the lens LE. Thereafter, the drill 435 is rotated by a motor 440 and the lens LE is moved toward the drill 435 in the chuck shaft direction (X-axis direction) by the motor 145, thereby performing drilling (for details of drilling, see Japanese Unexamined Patent Application Publication No. 2003-145328 [U.S. Pat. No. 6,790,124], Japanese Unexamined Patent Application Publication No. 2007.229861 [U.S. Pat. No. 7,500,315]).

When grooving is set, after the flat processing by the flat part of the finishing grindstone 164, the drilling and grooving mechanism 400 is driven, and the process shifts to grooving. The control unit 50 controls the movement position of a cutter 436 of the drilling and grooving mechanism 400 based on the grooving locus data (the grooving locus data is obtained in a similar manner to the bevel path), and performs grooving while rotating the lens LE (for details of grooving, see Japanese Unexamined Patent Application Publication No. 2003-145328 [U.S. Pat. No. 6,790,124]).

As described above, when a predetermined processing step according to the processing conditions that are set on the layout screen 500*a* and the other processing condition edit screens is finished, the lens chuck shafts 102L and 102R are returned to the initial positions based on a processing step end signal (automatically generated by the control unit 50). At the same time, the storage of the video picture taken by the camera 11 into the temporary storage memory 51*a* is stopped (ended) based on the processing step end signal. As to the processing step end signal, a case is included where some error is detected by the control unit 50 in the middle and the processing by the apparatus is stopped in the middle. A case is also included where as a control to stop the video picture storage into the memory 51*a*, the processing is stopped after a predetermined time has elapsed since the start of the video picture storage, based on the processing step end signal.

When the storage capacity of the memory 51*a* is large, the vide picture data may be continuously stored into the temporary storage memory 51*a* when the power of the apparatus is on as long as the storage capacity permits instead of controlling the storage of the video picture into the memory 51*a* every lens processing as described above. In this case, in order that the video picture at the time of the processing of each lens LE can be specified, the control unit 50 stores, into the memory 51*a*, video picture data provided with breaks (chapters) in the stage of the input of a predetermined operation start signal by the switch 7*a* or 7*b* and in the stage of the input of the processing end signal. By providing the processing start and processing end breaks, the video picture at the time of the processing of each lens LE can be managed.

A management number is automatically assigned to the video picture data of each lens processing stored in the temporary storage memory 51*a*, by the control unit 50. For example, video picture data management numbers are automatically provided such as "K0001", "K0002", . . . . At this time, the lens processing condition data that is set on the layout screen 500*a* and the like is also associated with the video picture management number as additional data, and the additional data is stored into the memory 51*a* together with the video picture data so as to be callable. The processing condition data includes the condition as to whether the lens selected by the switch 7*c* is a left lens or a right lens. The video picture data stored in the memory 51*a* is stored together with the processing condition data when the video picture data is obtained, into the same folder. A job number assigned to each lens processing, the date and time when the lens processing is performed or the like are automatically assigned to the folder as the folder name. This enables the processing data to be identified at a glance when the video picture data is called later.

If the edge position information of the lens front and rear surfaces obtained by the measurement units 800F and 300R is included as the additional data stored in the memory 51*a* so as to be associated with the video picture data, the information can be made good use of in finding the cause of a trouble at the time of the processing. Further, it is desirable that processing control data (control data of X-axis movement unit, Y-axis movement unit and lens rotation unit) based on the bevel path or the like calculated based on the inputted processing condition data and the lens edge position information be included as the additional data. Moreover, it is further desirable that actual time-series driving data be included since there are cases where the driving data of the actually driven X-axis movement unit, Y-axis movement unit and lens rotation unit is different from the processing control data when a trouble occurs. The driving data of the lens rotation unit is obtained by the encoder 121, the driving data of the X-axis direction movement unit is obtained by the encoder 146, and the driving data of the Y-axis direction movement unit is obtained by the encoder 158.

Since how the processing of the lens LE is going is taken by the camera 11 and the video picture data at the time of the processing the lens LE and the additional data such as the processing conditions are recorded in the memory 51 as described above, a trouble at the time of the processing can be easily handled, so that trouble handling can be expedited.

For example, in an example in which an abnormality occurs in the X-axis direction movement of the carriage 101 and the lens chuck shafts 102L and 102R are not rotated, the configuration of the lens periphery having been processed is completely different from the laid-out configuration. In an example in which an abnormality occurs in the Y-axis direction movement of the carriage 101 and this leads to variations in the vertical movement of the lens chuck shafts, the configurations of the processed lenses vary and the lenses are not processed as laid out. In such a case, when merely a result such that "the lens is not processed" is told to the serviceperson and there is no clue such as how the processing was going, it is difficult to find the cause and it takes time to handle the trouble. It is difficult to predict the cause of the trouble only from the information from the operator.

Abnormalities of the apparatus include mechanical abnormalities inherent to the apparatus and abnormalities due to defects of the control software caused when particular processing conditions conspire. In this case, unless the input data such as the processing condition is completely the same as that at the time of the occurrence of the trouble, the trouble is not reproduced, so that the serviceperson cannot handle it. When the input data such as the processing condition at the time of the occurrence of the trouble is lost and the trouble is not reproduced, it is difficult even for an expert to find the cause and handle it or it takes time to handle it appropriately. In addition, there are quite a few troubles that occur due to misoperations such that the operator erroneously inputs a processing condition, that the operator confuses the right and left lenses and that the operator does not perform the operation according to the procedure.

Figure 9A:
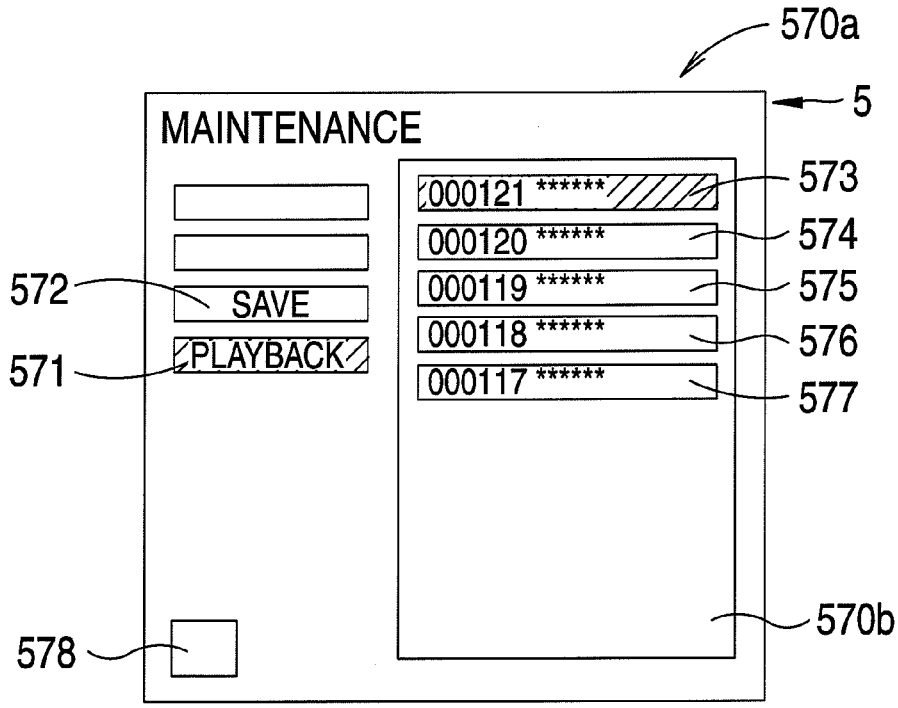
FIG. 9A shows an example of a maintenance screen.

When a trouble occurs such that the lens is not processed as laid out, the operator can check the operation during the processing by playing back the video picture (video picture data stored in the temporary storage memory 51*a*) recording the lens processing operation in the following manner:

When the menu button 560 is selected, the menu screen 560*a* is displayed. When the button 570 is selected on the menu screen 560*a*, the maintenance screen 570*a* is displayed. FIG. 9A shows an example of the maintenance screen 570*a*. Buttons such as a playback button 571 to play back video picture data stored in the temporary storage memory 51*a*, a storage button 572 to store, into the recording memory 51*b*, the video picture data and the additional data selected from the video picture data and the additional data stored in the temporary storage memory 51*a* are disposed on the left side of the maintenance screen 570*a*. A display screen 570*b* is displayed on the right side of the maintenance screen 570*a*. In the initial state of the maintenance screen 570*a*, buttons 573 to 577 on which the folder names of the video picture data stored in the temporary storage memory 51*a* are printed are selectably displayed on the display screen 570*b*. The buttons 573 to 577 correspond to the pieces of video picture data stored in the temporary storage memory 51*a* in the order in which they are obtained.

Figure 9B:
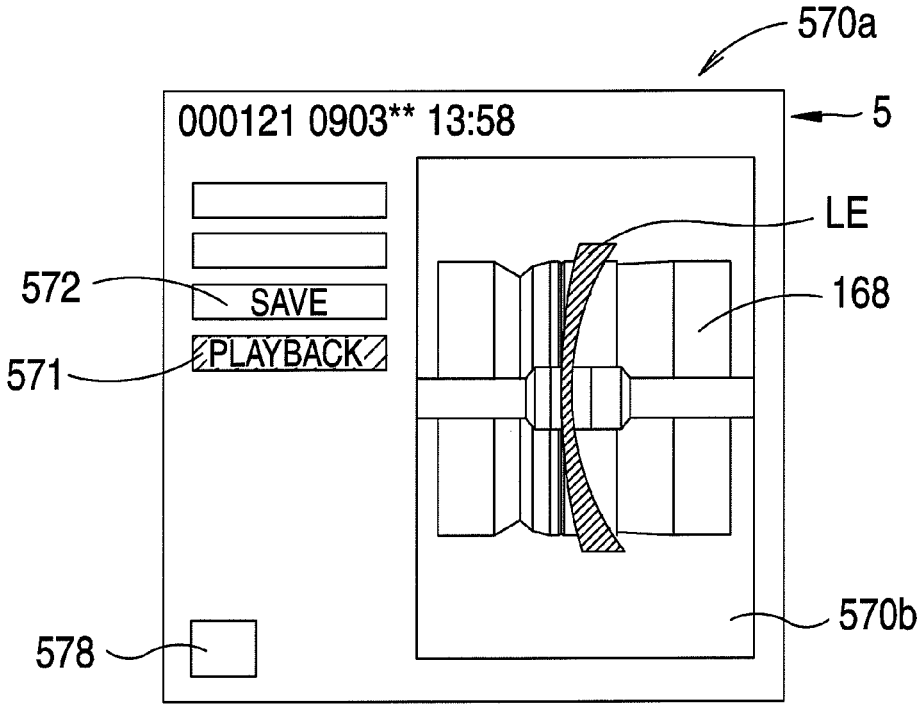
FIG. 9B shows a display screen for playing back a video picture.

The operator selects the button 573 for video picture specification in order to play back the latest video picture data. When the playback button 571 is pressed under this condition, the control unit 50 calls the video picture data specified by the button 573 from the memory 51*a*, switches the display of the display screen 570*b*, and plays back the video picture of the video picture data on the display screen 570*b*. FIG. 9B shows the display screen 570*a* when the video picture is being played back. The operator can check the series of operations during processing through the video picture displayed on the display screen 570*b*. At this time, when the button 578 is pressed, the control unit 50 switches the display on the display screen 570*b*, and displays the processing condition data stored in the same folder (the same display as the screen 500*a* of FIG. 7, or the processing condition data is displayed in list form). Or the processing condition is displayed so as to be superimposed on the video picture. Or the video picture and the processing condition may be displayed side by side. Further, it is more desirable that other additional data be displayed. This enables the operator to reproduce how the processing of the lens was going, the input condition of the processing conditions and the like where the trouble occurred. For example, in the case of a trouble caused by a simple operation error such as an error in inputting whether the lens is a right lens or a left lens, an error as to the target lens shape data or the type of processing (beveling, flat processing) and an error as to the presence or absence of grooving or drilling, there are cases where the operator can notice the cause of the trouble by himself or herself and handle it.

When the operator cannot find the cause of the trouble by himself or herself and has to explain the trouble to the serviceperson or the like, the video picture data and the additional data stored in the temporary storage memory 51*a* can be stored in the recording memory 51*b* in the following manner: The operator presses the storage button 572 under a condition where, of the buttons 573 to 577, a button corresponding to the video picture data that is necessarily stored is selected. The control unit 50 copies, of the video picture data stored in the temporary storage memory 51*a*, the corresponding data to the recording memory 51*b* based on the storage signal by the button 572. At this time, the additional data such as the processing condition data stored so as to be associated with the management number of the video picture data is called at the same time, and copied to the recording memory 51*b*. Thereby, the video picture data and the additional data temporarily stored in the temporary storage memory 51*a* are stored into the recording memory 51*b*, and are left there until a predetermined deletion signal is inputted. Thereby, even when lenses are continuously processed, the video picture data and the additional data of the lens where a trouble occurred are not automatically deleted but are left. The serviceperson or the like can check the video picture data and the additional data of the lens where the trouble occurred, on the display 5 in the same manner as that described above, and when the trouble is one the cause of which can be found by the serviceperson (for example, a simple misoperation or a defect of the input data), the serviceperson can handle it.

Figure 10:
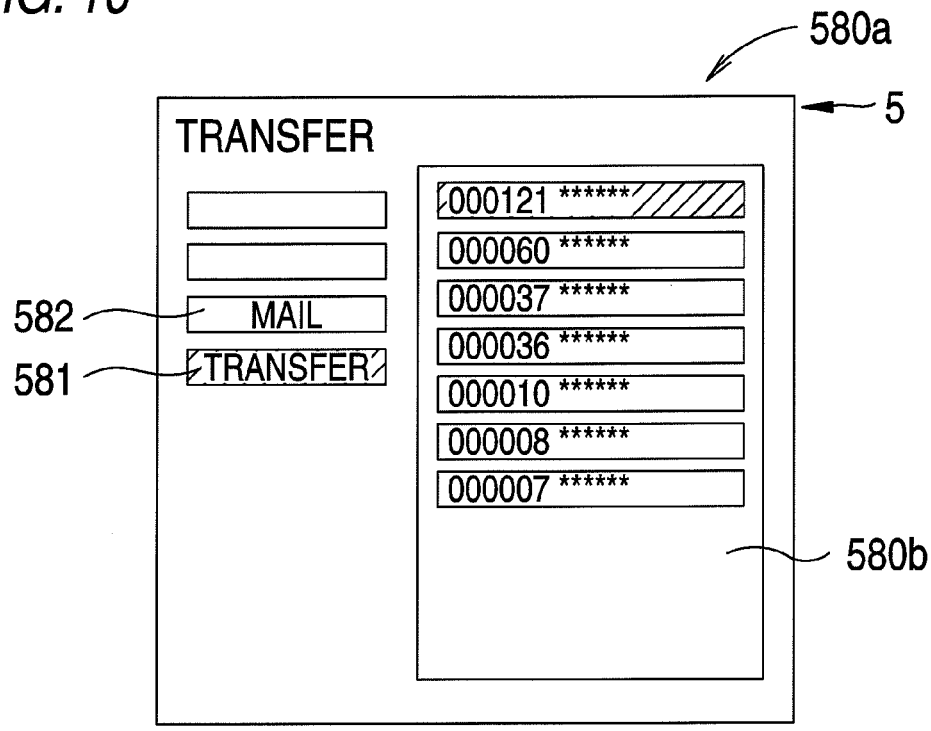
FIG. 10 shows an example of a transfer screen.

The video picture data and the additional data stored in the memory 51*b* (ditto for the memory 51*a*) can be taken out with the external storage device M. In this case, the operator (or a serviceperson, etc.) connects the external storage device M such as a USB memory to the connection unit 8, opens the menu screen 560*a*, and selects the button 580 for the transfer to the outside. When the button 580 is pressed, the screen 580*a* for selecting the data to be transferred is displayed on the display 5 as shown in FIG. 10. On the screen 580*a*, a list of the folders stored in the memory 51*b* is selectably displayed in a display box 580*b*. When the folder name of the video picture data is selected on the screen 580*b* and a transfer enter button 581 is pressed, the video picture data and the additional data of the corresponding file name are called from the memory 51*b* by the control unit 50, and transferred to the external storage device M.

For the troubles that neither the serviceperson nor the operator can handle, the video picture data and the additional data such as the processing condition where a trouble occurred are delivered to an expert engineer of the maker of the apparatus by using the external storage device M or the like. Thereby, even an engineer in a remote location can easily play back the video picture data and the additional data such as the processing condition at the time of the occurrence of the trouble.

Figure 11:
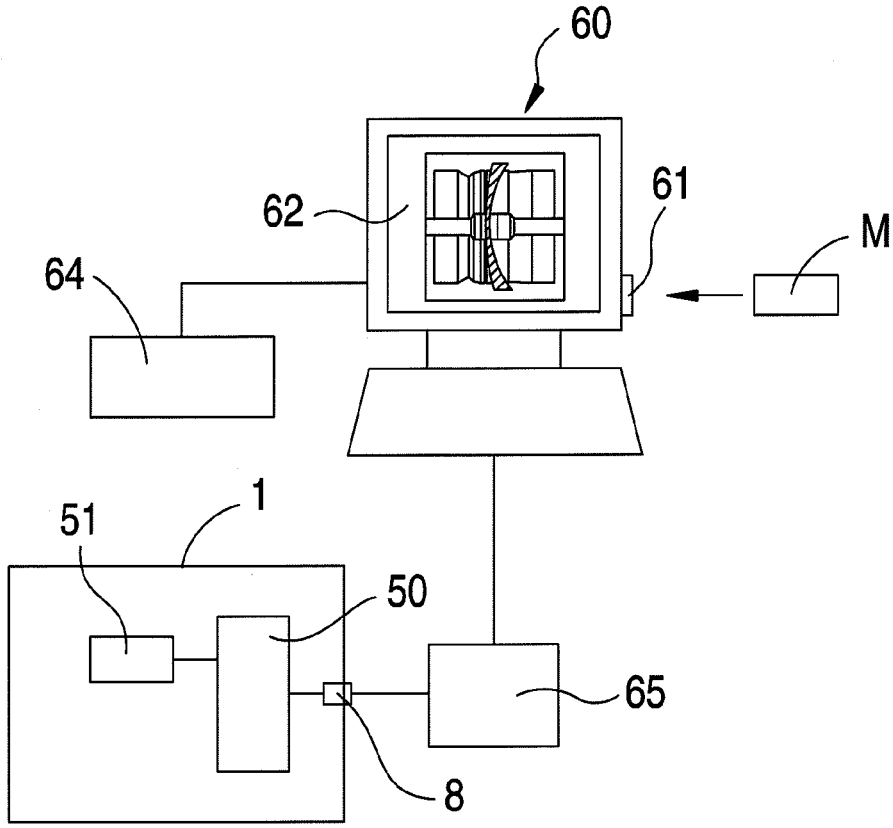
FIG. 11 is an explanatory view of a case where processing information is checked with a personal computer of the maker of the apparatus.

FIG. 11 is an explanatory view of a case where the processing information is checked by the maker of the apparatus by using a personal computer (hereinafter, referred to as PC) 60. The video picture data in the external storage device M connected to a connection unit 61 of the PC 60 is played back on a display 62 of the PC 60 by using commercially available playback software. The processing condition data in the external storage memory M is also displayed on the display 62. The additional data such as the processing condition can be outputted onto paper by a printer 64. Consequently, since the maker of the apparatus can check, through a video picture, not only the lens where the trouble occurred and the information verbally provided by the operator but also how the processing was going at the time of the occurrence of the trouble, accurate and detailed information can be made use of to analyze the cause of the trouble.

Troubles of the apparatus are caused by mechanical factors, electric factors and factors associated with the control program, and in the maker of the apparatus, engineers who are expert in each factor can analyze the trouble. When the additional data such as the processing condition data is present, whether the trouble of the lens processing can be reproduced under the same processing condition or not can be checked by using an eyeglass lens processing apparatus prepared by the maker (apparatus the same as the apparatus where the trouble is reported). This makes it easy to check a defect associated with the control program caused when particular processing conditions conspire. Further, when the lens edge position detection information is present in addition to the processing condition data, the trouble occurrence condition can be checked with the same lens. Moreover, when the processing control data at the time of the occurrence of the trouble and the time-series driving data of each mechanism are present as the additional data, even in a case where an abnormality is caused in the movement of the carriage 101 in the X-axis direction or the Y-axis direction as described above, the cause such as whether the trouble is a mechanical failure or an electric failure can be easily analyzed, which makes it easy to handle the trouble appropriately. Consequently, the apparatus can be quickly repaired In FIG. 11, in an environment where the apparatus body 1 and the PC 60 as the external storage device are connected through a communication line 65 of the Internet, the video picture and the processing condition data stored in the memory 51 (51*b*) of the apparatus body 1 are transferred through the communication line 65 to the PC 60 placed in a remote location. The communication line 65 is connected to an Internet connection port of the connection unit 8 of the apparatus body 1. The video picture and the additional data such as the processing condition data stored in the memory 51 can be transferred to the PC 60 of the maker by using the function of mail transmission on the Internet. For example, the mail transmission function is called by a button 582 shown in FIG. 10, and the video picture and the additional data such as the processing condition in the folder selected on the display box 580*b* are transferred to the PC 60 of the maker. When the communication line 65 is used, the maker can obtain the video picture data of the apparatus body 1 with ease physically and timewise, so that troubles can be handled more quickly. When the communication line 65 is used, naturally, communication with a plurality of apparatus bodies 1 can be performed by the PC 60. In this case, handling by the maker is facilitated.

By taking the video picture how the processing is going in the processing chamber 30 by the camera 11, the present invention is also used as follows: For example, it is assumed that a display unit 70 having a display (see FIG. 7) is connected to the apparatus body 1 and the display unit 70 is placed in a location away from the apparatus body 1. The video picture taken by the camera 11 is outputted to the display of the display unit 70 in real time. The control unit 50 serves also as a video picture output unit that outputs the video picture taken by the camera 11, to the display unit 70 in real time. At an eyeglass shop, a salesperson can find the progress of the lens processing by checking the video picture of the processing under way displayed on the display unit 70 while waiting on a customer.

Moreover, a structure may be adopted in which the video picture data taken by the camera 11 is processed and it is determined whether the lens LE is appropriately attached to the lens chuck shaft 102L or not. For example, in the chucking, the control unit 50 analyzes the video picture data in the processing chamber 30 taken by the camera 11 to thereby determine whether the lens LE on the lens chuck shaft 102L is present or absent. When the lens LE is not attached, an error message is displayed on the display 5. If the color of the cup attached to the chuck shaft 102L is determined by the video picture processing by the control unit 50, the right and left lenses to be processed are prevented from being confused when attached.

What is claimed is:

1. An eyeglass lens processing apparatus comprising:

a processing chamber;

a pair of lens chuck shafts which is disposed in the processing chamber and chucks an eyeglass lens;

a lens rotating unit including a motor for rotating the pair of lens chuck shafts;

a processing tool which is disposed in the processing chamber and processes a periphery of the lens;

an axis-to-axis distance changing unit including a motor for changing an axis-to-axis distance between a rotating shaft attached to the processing tool and the lens chuck shafts;

a data input unit for inputting processing condition data including a target lens shape;

a processing controller which controls the lens rotating unit and the axis-to-axis changing unit to process the periphery of the lens based on the input processing condition data;

a camera which is disposed in the processing chamber and has an angle of view where the camera can take a video picture of the processing of the lens by the processing tool;

a memory which stores video pictures taken by the camera and processing condition data input by the input unit; and a specifying unit configured to selectively read out a particular video picture and a particular processing condition data among the video pictures and the processing condition data stored in the memory to display the read-out particular video picture on a display or transmit the read-out video picture to an external storage device.

2. The eyeglass lens processing apparatus according to claim 1, wherein the specifying unit includes a display controller which controls the display to play back the specified video picture by reading out the specified video picture from the memory, and controls the display to display one of the processing condition data of the lens of the specified video picture by reading out one of the processing condition data of the lens of the specified video picture from the memory.

3. The eyeglass lens processing apparatus according to claim 1 further comprising:

a connection unit which is connectable to the external storage device;

wherein the specifying unit includes a data transmission controller which transmits the specified video picture from the connection unit to the external storage device by reading out the specified video picture from the memory, and transmits one of the process condition data of the lens of the specified video picture as additional data from the connection unit to the external storage device by reading out one of the process condition data of the specified video picture from the memory.

4. The eyeglass lens processing apparatus according to claim 3, wherein the memory stores processing control data, the data transmission controller transmits one of the processing control data of the lens of the specified video picture as the additional data from the communication unit to the external storage device by reading out one of the processing control data of the lens of the specified video picture from the memory.

5. The eyeglass lens processing apparatus according to claim 3 further comprising a detector which includes a tracing stylus contacting with a refractive surface of the lens and a sensor for detecting a movement of the tracing stylus, and detects an edge position of the lens based on the target lens shape, wherein the memory stores detecting results of the edge position by the detector, and wherein the data transmission controller transmits one of the detecting results of the edge position of the lens of the specified video picture as the additional data from the communication unit to the external storage device by reading out one of the detecting results of the edge position of the lens of the specified video picture from the memory.

6. The eyeglass lens processing apparatus according to claim 1 further comprising:

a switch for inputting a processing start signal for starting the processing of the lens; and a storage controller which stores the video picture taken by the camera and the processing condition data in the memory, wherein the storage controller stores the video picture and the processing condition data in the memory, in such a manner that the video picture and the processing condition data can be specified, based on the processing start signal and an end signal indicative of an end of the processing from the processing controller.

* * * * *